US011096551B2

(12) United States Patent
Chaffee et al.

(10) Patent No.: US 11,096,551 B2
(45) Date of Patent: Aug. 24, 2021

(54) FOAM DISPENSING CLEANING TOOL

(71) Applicant: 3M INNOVATIVE PROPERTIES COMPANY, St. Paul, MN (US)

(72) Inventors: Matthew D. Chaffee, Minneapolis, MN (US); Megan E. Renner, San Francisco, CA (US); Lloyd S. Vasilakes, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 72 days.

(21) Appl. No.: 16/622,093

(22) PCT Filed: Jun. 15, 2018

(86) PCT No.: PCT/US2018/037713
§ 371 (c)(1),
(2) Date: Dec. 12, 2019

(87) PCT Pub. No.: WO2018/232215
PCT Pub. Date: Dec. 20, 2018

(65) Prior Publication Data

US 2021/0186301 A1 Jun. 24, 2021

Related U.S. Application Data

(60) Provisional application No. 62/520,750, filed on Jun. 16, 2017.

(51) Int. Cl.
*A47L 17/04* (2006.01)
*A47L 13/17* (2006.01)

(52) U.S. Cl.
CPC ..... *A47L 17/04* (2013.01); *A47L 13/17* (2013.01)

(58) Field of Classification Search
CPC ..... A47L 13/03; A47L 13/17; A47L 13/19; A47L 13/22; A47L 13/26; A47L 17/04
See application file for complete search history.

(56) References Cited

U.S. PATENT DOCUMENTS

| | | | |
|---|---|---|---|
| 3,181,196 | A | 5/1965 | Knightly |
| 2006/0032944 | A1 | 2/2006 | Hornsby |
| 2016/0157596 | A1 | 6/2016 | Fifield |

FOREIGN PATENT DOCUMENTS

WO WO 2014/116099 A1 * 7/2014

OTHER PUBLICATIONS

International Search Report for PCT International Application No. PCT/US2018/037713, dated Sep. 17, 2018, 4 pages.

* cited by examiner

*Primary Examiner* — Randall E Chin

(57) ABSTRACT

The present invention is a cleaning tool for dispensing foam. The cleaning tool includes a handle having a working end and a holding end, a cleaning head attached to the working end of the handle, a foaming mechanism, and an actuator to displace volume within the foaming mechanism. The foaming mechanism includes a chamber, an air pocket, an air tube having an air inlet, a fluid inlet, a fluid reservoir, and a foaming pump.

20 Claims, 10 Drawing Sheets

FOAM DISPENSING CLEANING TOOL

FIELD OF THE INVENTION

The present invention is related to the field of cleaning tools. In particular, the present invention is a foam dispensing cleaning tool.

BACKGROUND

Cleaning tools are commonly used for cleaning dishes, bathrooms, walls, fabric, and showers. These cleaning tools can have various types of cleaning heads for different types of cleaning tasks. Depending on the cleaning task, the cleaning head can be made of various materials, such as foam, sponge, fabric, bristles, and scrubbing webs. In some cases, the cleaning heads may be attached to a solid or semi-flexible handled tool. Cleaning chemicals, solutions, or mixtures, such as dishwash detergents or general purpose cleaners, are often used in combination with the cleaning tools to aid in the cleaning process. Some cleaning tools include a chamber for holding solid or liquid cleaning mixtures that can be dispensed onto the surface to be cleaned or directly into the cleaning head. Certain cleaning tools, such as dish cleaning tools, require the user to pour the dishwash detergent into the chamber of the cleaning tool. The user is then required to dispense the cleaning mixture onto the surface to be cleaned or onto the cleaning head and work the cleaning tool around the surface to be cleaned.

Consumers often prefer cleaning mixtures that form a foam due to the advantages of foam over liquid solutions. For example, foam requires less soap to make an efficient cleaning solution, resulting in reduced costs. Foam is also more effective at cleaning/trapping debris due to the increased surface area.

In order to create foam from a dispenser, there must be an appropriate mixture of liquid and air. Thus, any container that dispenses foam must contain inputs of both liquid and air, with the air generally supplied from a functional air pocket or separate chamber. In one embodiment, the container 1 is filled with about one third air and two thirds liquid, but is not limited to this ratio. Typical foaming mechanisms, such as, for example, a hand soap foaming dispenser with a push pump, work when the cleaning tool is positioned in a generally upright position. The majority of push pump hand soap dispensers do not work effectively when in an inverted position when the foaming pump is below the fluid and air pocket. Typically, push pump hand soap dispensers dispense when the foaming pump is above the fluid and air pocket. Push pump dispensers also require the user to push or translate a mechanism, which can be difficult to accomplish with one hand.

Another type of foaming mechanism, shown in FIG. 1A, allows a container 1, such as a hand squeeze bottle, to be used in an inverted position with the cleaning head 10 positioned downward and the foaming pump 14 positioned below the fluid 16 and air pocket 18. The foaming mechanism of FIG. 1A also allows the user to dispense foam with, for example, the push of a button or the squeeze of the container 1. In the prior art embodiment shown in FIG. 1A, the container 1 includes an air tube 12 connected to a foaming pump 14 surrounded by liquid 16. The end of the air tube 12 that is open within the container 1 must remain above the liquid level while dispensing foam otherwise liquid 16, instead of air, will enter the air tube 12, preventing foam from being produced. FIG. 4B shows an embodiment in which there is no air pocket or air within the container 1.

SUMMARY

In one embodiment, the present invention is a cleaning tool for dispensing foam. The cleaning tool includes a handle having a working end and a holding end, a cleaning head attached to the working end of the handle, a foaming mechanism, and an actuator to displace volume within the foaming mechanism. The foaming mechanism includes a chamber, an air pocket, an air tube having an air inlet, a fluid inlet, a fluid reservoir, and a foaming pump.

In another embodiment, the present invention is a cleaning tool for dispensing foam. The cleaning tool includes a handle having a working end and a holding end, a cleaning head attached to the working end of the handle, a foaming mechanism, and an actuator for building pressure within the foaming mechanism. The foaming mechanism includes a chamber, an air pocket, an air tube having an air inlet, a fluid inlet, a fluid reservoir, and a foaming pump positioned in the fluid reservoir.

The illustrated embodiments are not intended to be exhaustive of all embodiments according to the invention. It is to be understood that other embodiments may be utilized and structural or logical changes may be made without departing from the scope of the present invention.

DETAILED DESCRIPTION

Figure 1A:
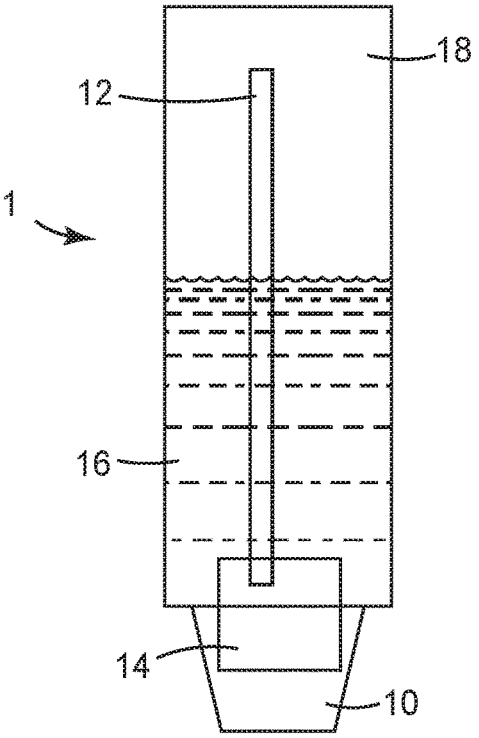
FIG. 1A Prior Art
FIG. 1A is a schematic view of a prior art foaming dispenser in a rest position and having an air pocket.
Figure 1B:
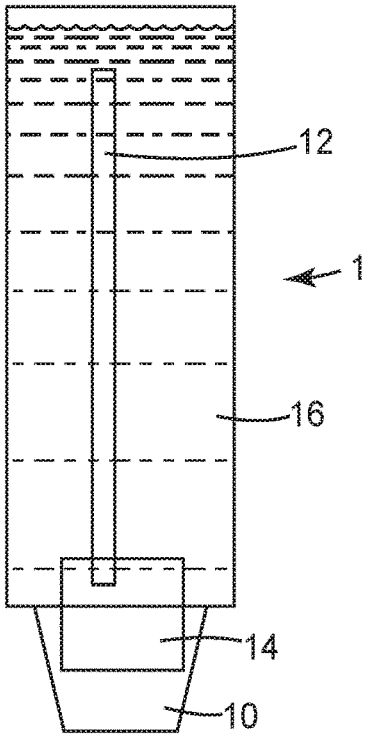
FIG. 1B Prior Art
FIG. 1B is a schematic view of the prior art foaming dispenser of FIG. 1A in a rest position without an air pocket.
Figure 2:
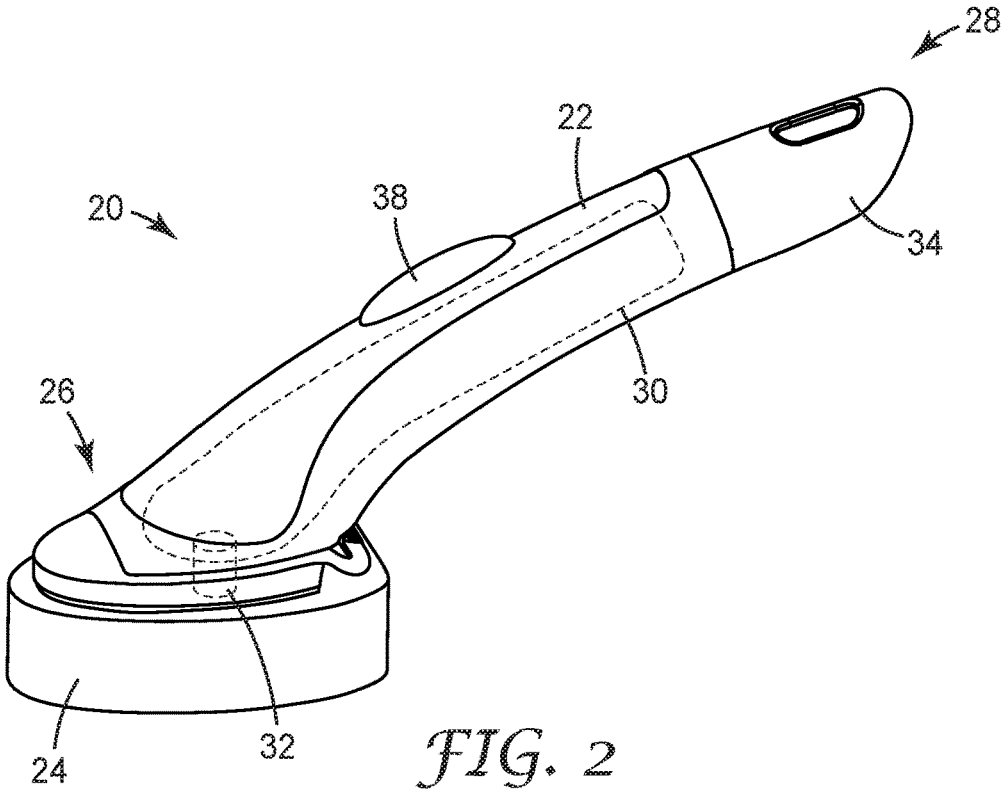
FIG. 2 is a perspective view of an embodiment of a cleaning tool of the present invention.

FIG. 2 shows a perspective view of an embodiment of a cleaning tool 20 of the present invention. The cleaning tool 20 incorporates a foaming mechanism (not shown in FIG. 2) and a method for design integration. The cleaning tool 20 can be used for various cleaning tasks, on various surfaces, and with various cleaning mixtures. The cleaning tool 20 is designed to dispense foam even when the cleaning tool 20 is in an inverted or substantially inverted position, or when the cleaning head of the cleaning tool 20 is substantially parallel with a surface to be cleaned. In addition to the benefits of foam, having a cleaning tool 20 that is capable of immediately dispensing foam also enhances the user's cleaning experience because of the instantaneous creation of suds to initiate cleaning and greater visual feedback from foam. This feedback is in the form of better visual awareness of when the cleaning mixture is dispensed, how much is dispensed, and a greater sense of control than traditional slit valves used in cleaning tools that only dispense liquid soap. The cleaning tool 20 of the present invention provides the convenience of having a cleaning mixture located within the cleaning tool 20 for easy and quick dispensing, along with both the functional and experiential benefits of foam. In one particular embodiment, the cleaning tool 20 is a dishwand that dispenses foam.

The cleaning tool 20 generally includes a handle 22 and a cleaning head 24. The handle 22 includes a working end 26 and a holding end 28 opposite the working end 26. The cleaning head 24 is attached at the working end 26 of the handle 22 and in practice, the user grips the cleaning tool 20 at or proximate the holding end 28 of the handle 22. The handle 22 also includes a chamber 30, a discharge aperture 32, and an end cap 34. The chamber 30 can hold a fluid such as a cleaning mixture or chemical or other solution effective for cleaning or treating a surface. The chamber 30 is sized to hold a foaming mechanism 36 (shown in FIGS. 3A and 3B) and can take up all or a portion of the handle 22. In one embodiment, the chamber 30 is positioned adjacent the holding end 28 of the handle 22. In one embodiment, the chamber 30 resides in the end cap 34.

The discharge aperture 32 is generally located at the working end 26 of the handle 22 adjacent the cleaning head 24. In one embodiment, the discharge aperture 32 is slightly removed from the cleaning head 24. Because the discharge aperture 32 is located adjacent the cleaning head 24, foam is readily discharged into or through the cleaning head 24 to be used for cleaning. It should be noted that while the discharge aperture 32 is depicted in FIG. 2 as being positioned along the handle 22 and in contact with the cleaning head 24, the discharge aperture 32 can also be positioned within the cleaning head 24, removed from the cleaning head 24, or positioned anywhere along the handle, including at the holding end 28 of the cleaning tool 20. An advantage of placing the discharge aperture 32 along the handle 22 is ease in manufacturing, resulting in potential cost savings. It should also be understood that although a single discharge aperture 32 is depicted in FIG. 2, more than one discharge aperture can be included without departing from the intended scope of the present invention.

The end cap 34 is located at the holding end 28 of the handle 22. The end cap 34 can be removed from the handle 22 to allow access into the chamber 30. When the end cap 34 is positioned on the handle 22, the end cap 34 covers the chamber 30 and maintains the fluid and/or cleaning mixture within. Any number of attachment mechanisms can be used for removably securing the end cap 34 to the handle 22 as will be understood by those of skill in the art. For example, threads and rubber gaskets can be used. In one embodiment, a substantial portion of the handle 22 is removable from the cleaning tool 20. This removable portion can be removed and re-attached to allow for refilling of the fluid into the chamber 30.

In some embodiments, the cleaning tool 20 includes an actuator 38, such as a push button, to aid in dispensing foam out of the chamber 30 at the discharge aperture 32. In embodiments that include an actuator, the actuator 38 is in communication with the foaming pump (shown in FIGS. 3A and 3B) and is resilient and depressible. Depressing the actuator 38 displaces volume inside the chamber 30, increasing internal pressure and forcing both fluid and air within the chamber 30 through foaming pump inlets. The fluid and air then mix together inside the foaming mechanism, dispensing foam through the discharge aperture.

The handle 22 may have any shape, arrangement, or length and can be constructed of various materials. For example, suitable materials include, but are not limited to: plastic, metal, wood, thermoplastics, elastomers, and similar rigid or semi-flexible materials. Specifically, various elastomers, and o-rings, can be used in and around the valve, end cap, or other mating components for a better seal. Examples of suitable handles include, but are not limited to: a rigid plastic handle, a squeezable or deformable handle, an aluminum or steel handle, an extendable handle, a dishwand, or a palm brush. In one embodiment, the handle 22 may contain batteries or other power supply to provide movement of the cleaning head 24 to reduce user input and increase performance. For example, the cleaning tool 20 may include an ultrasonic mechanism in the cleaning head 24 or be similar to an orbital sander.

The cleaning head 24 is attached to the working end 26 of the handle 22 and contacts the surface to be cleaned. The cleaning head 24 is attached to the handle 22 by, for example, a shoe. In one embodiment, the shoe is formed of plastic. The cleaning head 24 may either be a permanent feature of the cleaning tool 20 or may be replaceable when it is no longer satisfactorily efficient. The cleaning head 24 is constructed of a material suitable for cleaning. In one embodiment, the cleaning head 24 may be constructed of a material suitable for wiping, washing, scrubbing, and/or scouring. In one embodiment, the cleaning head 24 is constructed of more than one material. Exemplary materials suitable for the cleaning head include, but are not limited to: synthetic or cellulose foam, fabric such a woven, knitted, or nonwoven fabric, scouring webs, bristles, or a combination of one or more of these materials.

Figure 3A:
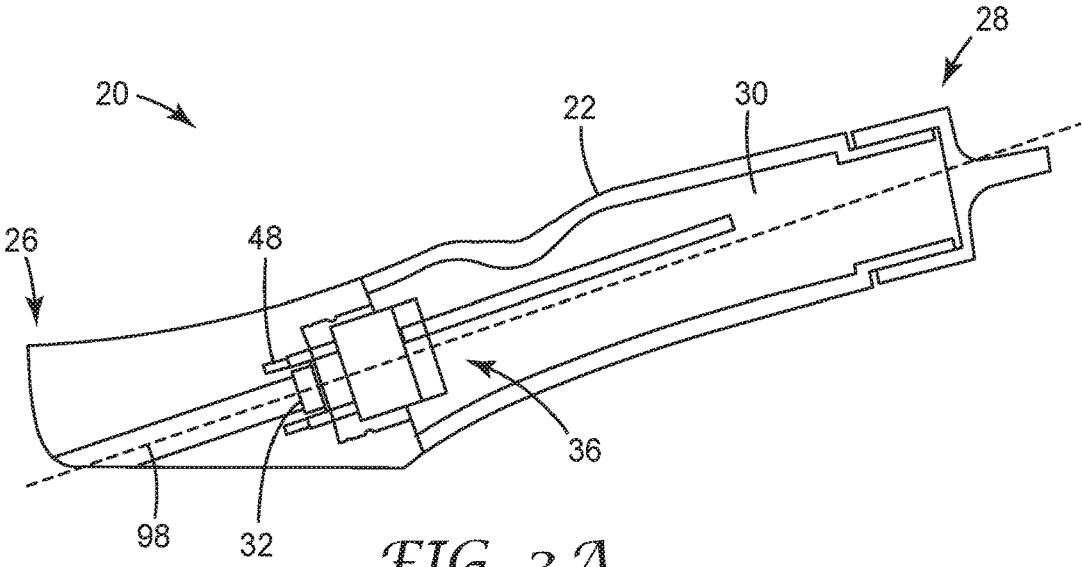
FIG. 3A is a cross-sectional view of an embodiment of the cleaning tool of the present invention.
Figure 3B:
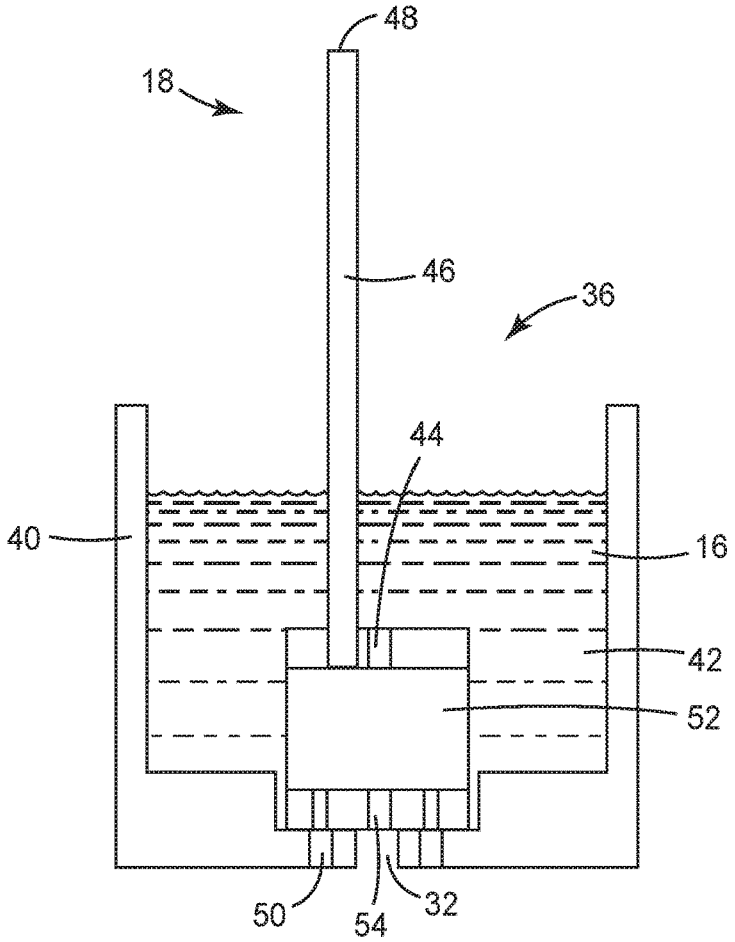
FIG. 3B is an enlarged cross-sectional view of a foaming mechanism of the cleaning tool of FIG. 3A of the present invention.

FIG. 3A shows a cross-sectional view of an embodiment of the cleaning tool 20 of the present invention including a foaming mechanism 36. FIG. 3B shows an enlarged cross-sectional view of the foaming mechanism 36 of the cleaning tool 20. The foaming mechanism 36 generally includes the chamber body 40, and air pocket 18, a fluid reservoir 42 that contains the fluid 16, a fluid inlet 44, an air tube 46 having an air inlet 48, an air return 50, a foaming pump 52, and a foam outlet 54. The fluid reservoir 42, air tube 46, and air return 50 are connected to the foaming pump 52. As can be seen in FIG. 3A, for proper dispensing of foam, the foaming pump 52 is generally submerged within the fluid 16 in the fluid reservoir 42 so that the fluid inlet is always in communication with the fluid reservoir 42. The foam outlet 54 generally contains a mesh to aid in mixing and foam creation during discharge.

The foaming pump 52 is positioned between the chamber 30 and the discharge aperture 32 and functions partly as a valve that allows for controlled release or containment of the fluid 16 and air from the air pocket 18 within the chamber 30. The foaming pump 52 is switchable between an open position and a closed position. When in the open position, the discharge aperture 32 is in fluid communication with the chamber 30 and therefore allows fluid 16 and air from the air pocket 18 to flow through the foaming pump 52. When in the closed position, the foaming pump 52 prevents fluid communication with the chamber 30 to the discharge aperture 32 and therefore stops the flow of fluid 16 and air from the air pocket 18 through the foaming pump 52. This allows the user to control the amount of foam discharged from the handle 22.

The handle 22 is designed to work with the foaming pump 52. Different attributes that therefore need to be considered in the overall form of the handle, include, for example: the shape, size, material, and tool orientation. The location and orientation of the foaming pump 52 within the handle 22 of the cleaning tool 20 may be critical for proper functionality. Traditionally, the foaming pump 52 would be vertical relative to the surface to be cleaned. However, when incorporated into a cleaning tool of the present invention, because of the height of the foaming pump 52, depending on the position of the handle 22, when the foaming pump 52 is vertical relative to the surface to be cleaned, there could be a substantial amount of fluid 16 that would pool around the foaming pump 52 such that the fluid 16 would not actually enter the fluid inlet 44 at the top of the foaming pump 52, and thus be unusable to create foam. To account for this, the foaming mechanism 36, and thus the foaming pump 52, can be oriented at an angle more in-line with the axis of the handle 22 of the cleaning tool 20. When the axis of the foaming mechanism 36 is aligned with the axis of the handle 22 and positioned in a recess to the chamber, the fluid 16 can go directly into the fluid inlet 44 at the top of the foaming pump 52, as seen FIG. 3A.

Figure 4A:
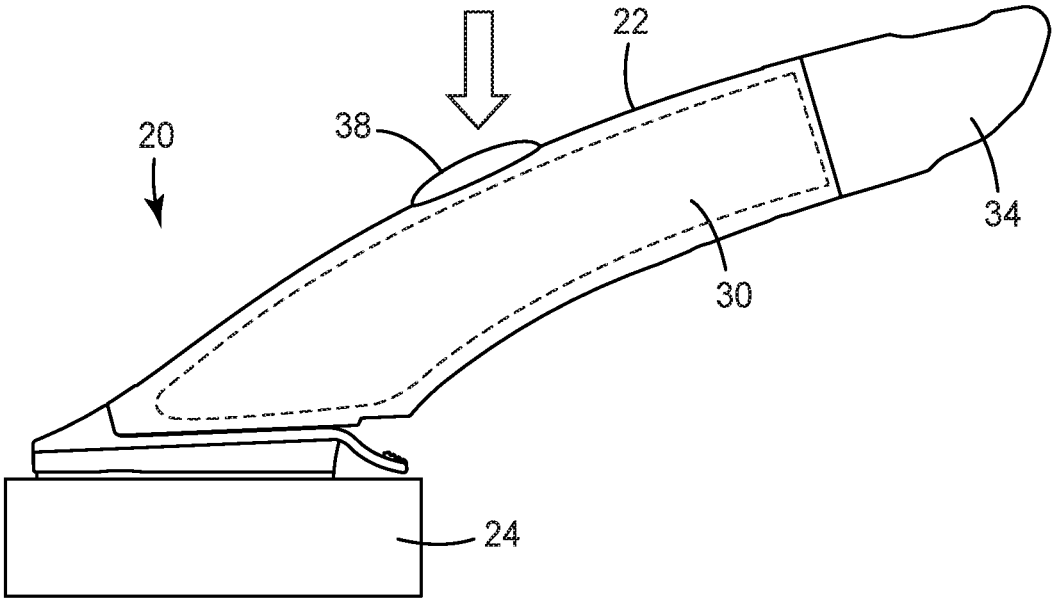
FIG. 4A is a side view of an embodiment of a dishwand handle of the present invention having an actuator.
Figure 4B:
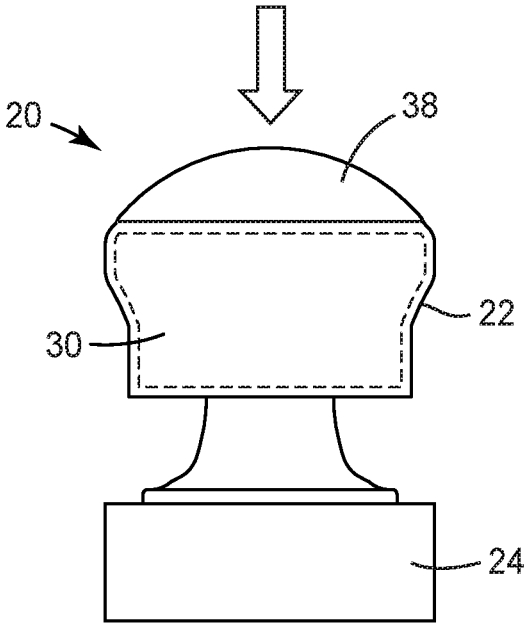
FIG. 4B is a side view of an embodiment of a palm handle of the present invention having an actuator.

In one embodiment, the cleaning tool 20 uses the actuator 38 to generate pressure inside the chamber 30. The actuator 38 can be located anywhere along the handle 22 of the cleaning tool 20. For example, it can be located along the handle 22 adjacent the chamber 30 as seen in traditional dishwands (FIG. 4A), on the handle and on top of the chamber 30 of a palm handle (FIG. 4B), at the working end of a handle, at the holding end 28, or in the end cap 34 to generate the pressure. When an actuator is used, it must be of sufficient size and flexibility to allow a sufficient total internal chamber volume displacement to build up enough pressure within the chamber 30 to dispense fluid 16 and air from the air pocket 18 into the foaming pump 52 and at a sufficient displacement rate to allow proper mixing to create foam. If the rate of volume displacement is not high enough, the air and fluid will not mix properly, resulting in only liquid or poor foam characteristics. The actuator 38 must also be constructed to allow appropriate spring back, or return to static state, to draw air back into the chamber 30 through the air return 50 to prevent building up a vacuum inside the chamber 30. There is thus a direct relationship between the size of the actuator and the volume of the fluid reservoir.

Figure 5:
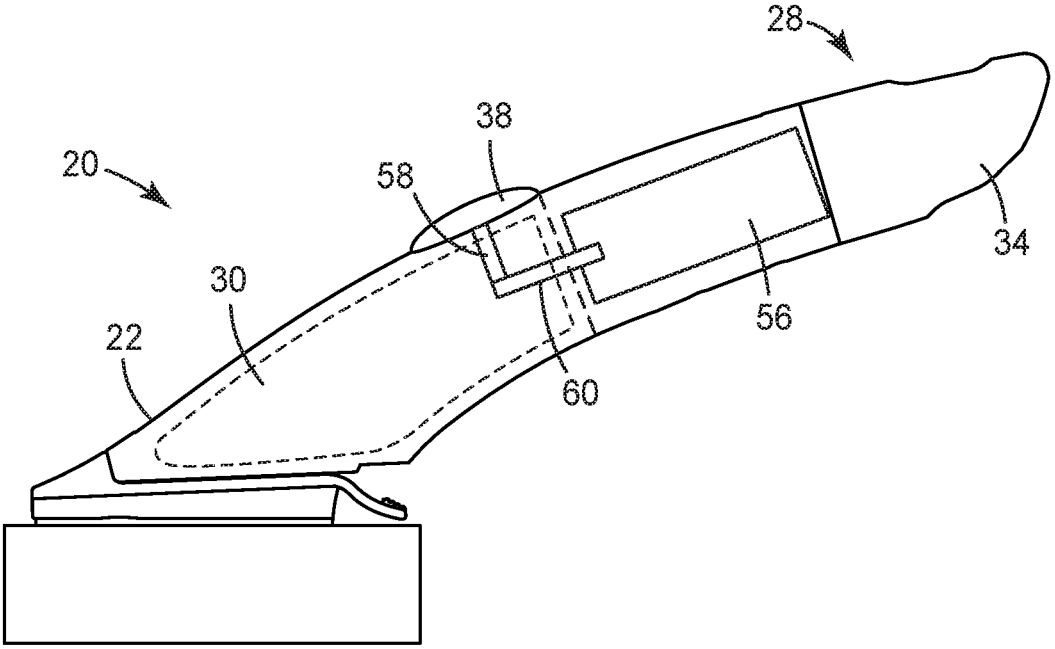
FIG. 5 is a side view of an embodiment of the cleaning tool of the present invention having a compressed air cartridge.

To increase the amount of pressure generated within the chamber 30, various mechanisms can optionally be used. In one embodiment shown in FIG. 5, a compressed air cartridge 56 can be positioned inside the cleaning tool 20 to discharge air into the chamber 30 when foam is desired. The discharged air from the cartridge 56 is used to generate pressure inside the chamber 30, forcing both fluid and air through the foaming pump 52 inlets to generate foam. In one embodiment, the compressed air is released when the actuator 38 is pressed and contacts a lever 58, which in turn opens an air discharge channel 60 of the compressed air cartridge 56.

Figure 6:
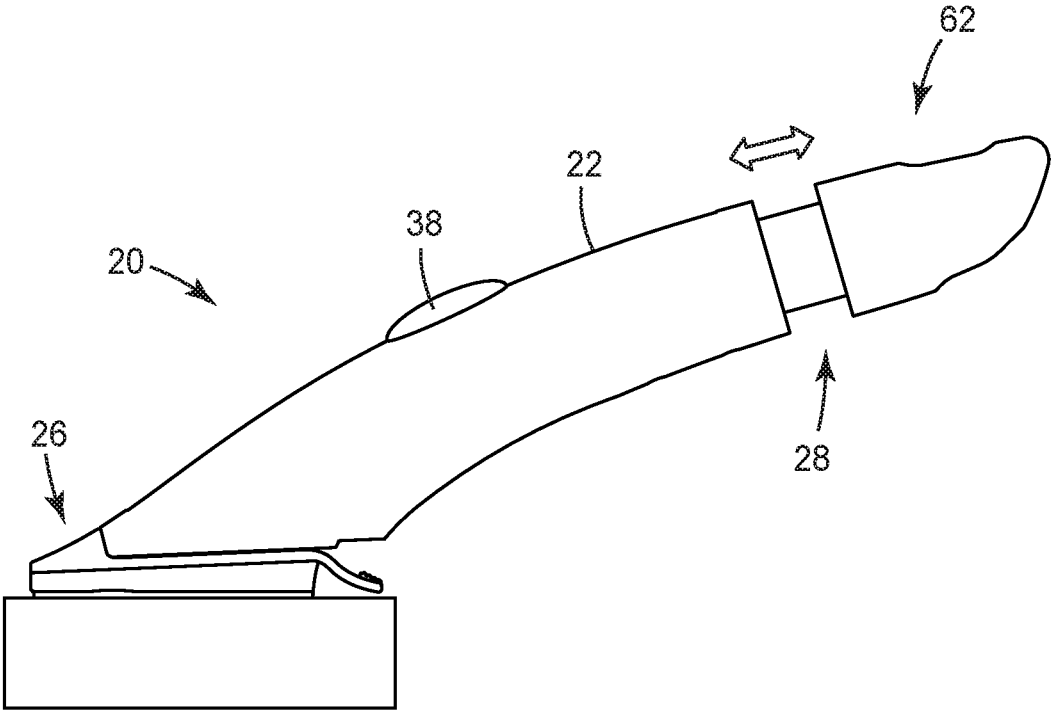
FIG. 6 is a side view of an embodiment of the cleaning tool of the present invention having a pressurizing pump.

Additional pressure can also be generated in the chamber 30 with a pump 62, as shown in a side view of the cleaning tool 20 in FIG. 6. In the embodiment shown in FIG. 6, the handle 22 includes a pressurizing pump 62 at the holding end 28 of the handle 22 that can be repeatedly actuated to pressurize the chamber 30 within the handle 22 by pumping air from the atmosphere into the chamber 30 with each cycle, resulting in a higher internal pressure than outside atmosphere pressure, similar to how pressure pump water or fluid sprayers currently on the market function. In an embodiment where there is no opening and closing actuator located after the foaming mechanism 36, the foaming mechanism 36 would push foam out with every cycle so long as the internal pressure is greater than atmospheric. In an embodiment in which there is an opening and closing actuator positioned after the foaming mechanism 36 to seal the chamber 30, pressure can be built up within the cleaning tool 20 and foam can be dispensed as needed by opening, for example, an actuator, or block, and foam could be dispensed through the discharge aperture. Foam would continue to be dispensed as long as the aperture, actuator, or block is open and the pressure inside the chamber 30 is greater than atmospheric pressure.

Another critical element of the foaming mechanism 36 is that air is resupplied back through the air return 50 to the air pocket 18 after a foam cycle in order to prevent a vacuum from being created inside the chamber 30. If a vacuum is created inside the chamber 30, it would be difficult to subsequently dispense foam as air would discontinue to flow through the foaming mechanism 36. Preventing a vacuum within the chamber 30 can be accomplished in various ways. In one embodiment, air return vents are designed into the foaming pump 52 that can rely on the actuator 38 in the handle 22 to spring-back or rebound enough to suck air back into the chamber 30. If the actuator 38 does not provide enough air back into the chamber 30 or the air return vents 50 in the foaming pump 52 are obstructed, other means can be included in the cleaning tool 20, such as one-way air valves pulling air from the atmosphere external to the cleaning tool body.

Figure 7:
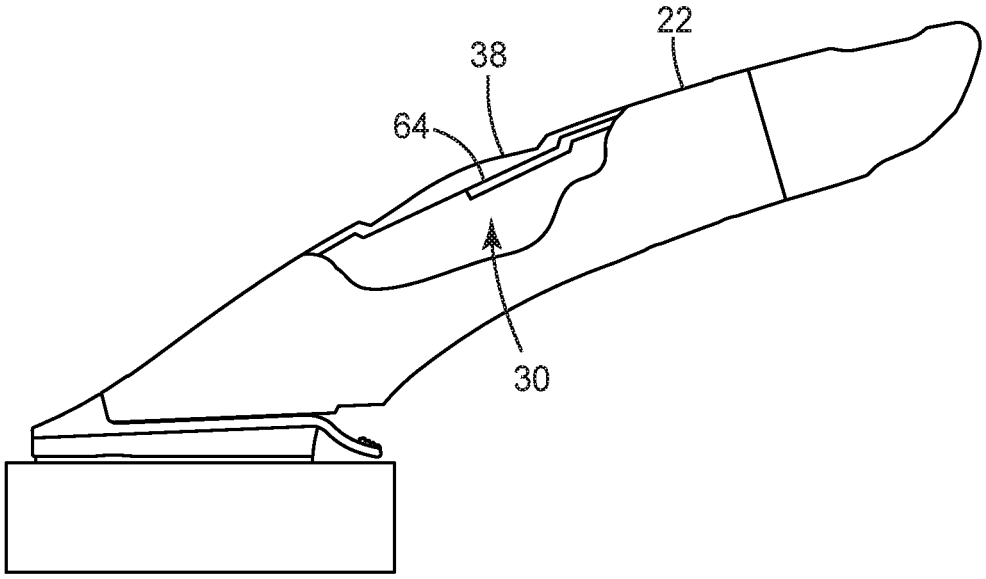
FIG. 7 is a side view of an embodiment of the cleaning tool of the present invention having a supporting lever.
Figure 8:
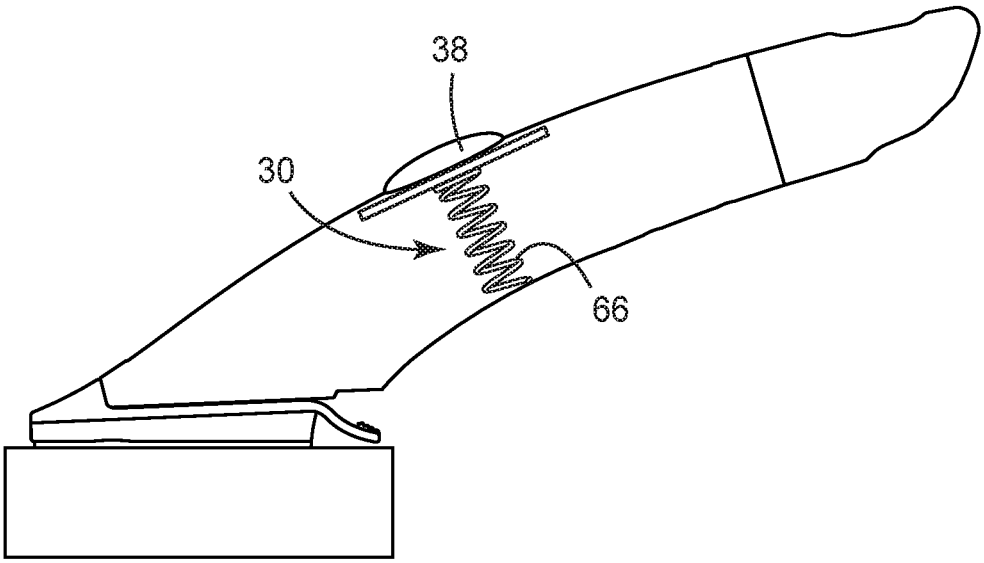
FIG. 8 is a side view of an embodiment of the cleaning tool of the present invention having a supporting spring.

In one embodiment, a feature can be positioned under the actuator 38 to increase spring-back and facilitate air return into the chamber 30 by providing a support structure to return to static state. As the actuator 38 returns to static state from the depressed state, after foam is dispensed, the rate of volume displacement change pulls air through air return vents 50 as the internal volume of the chamber 30 increases to static state. An example of a feature is a lever 64 (shown in FIG. 7) with defined rigidity and spring-back force located under the actuator to provide additional spring-back force for the actuator to return to its original position. In one embodiment, the lever 64 is formed of plastic and is molded into the handle 22. In another embodiment, a spring 66 (shown in FIG. 8) of traditional coiled construction or elastomeric properties is positioned under the actuator 38 to ensure rebound of the actuator 38 and sufficient suck-back through the air return 50 of the foaming mechanism 36.

Figure 9:
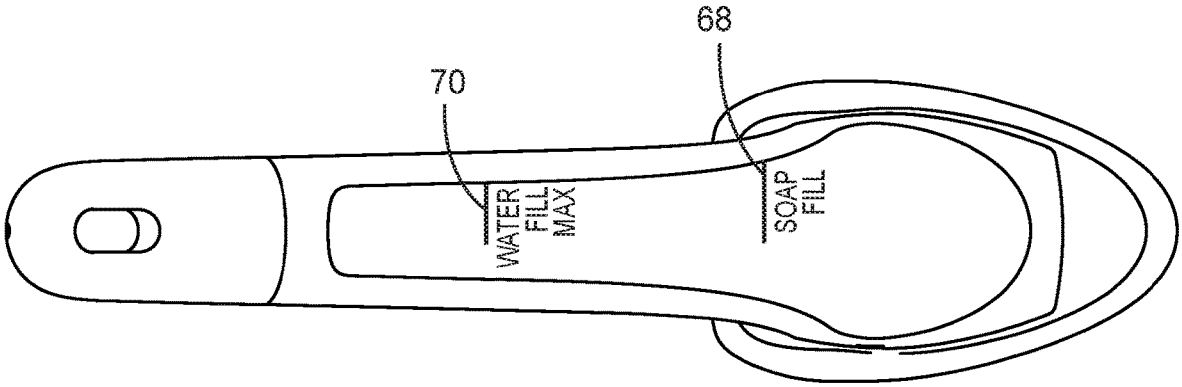
FIG. 9 is a top view of an embodiment of the cleaning tool of the present invention having fluid fill markings.

In addition to preventing a vacuum within the chamber, it is important to have the air inlet 48 of the air tube 46 in communication with the air pocket 18 within the chamber 30 in order to move air to the foaming pump 52 to mix with fluid 16 from the fluid reservoir 42 to produce foam. In an embodiment shown in FIG. 9, to maintain a proper air pocket within the chamber 30, a maximum soap refill line 68 and maximum fluid/water refill line 70 is marked on the exterior of the handle 22 so that the user does not overfill the chamber 30 with fluid and water. This will prevent the fluid from entering the air tube 46 during the foaming operation.

For traditional loaded cleaning tools, the user fills the handle 22 with the fluid or dish soap of their choice directly into the loaded cleaning tool, which is then dispensed via gravity or with an elastomeric valve. With the foaming pump 52 included in the cleaning tool 20 of the present invention, the fluid 16 has a viscosity requirement and requires a low level of surfactant within the fluid to obtain proper foaming. In one embodiment, the viscosity of the fluid 16 is between about 1 and about 10 mPa·s. In one embodiment, adding water to traditional or existing dish soap reduces the viscosity for effecting foaming. This ratio of soap to water can be further tailored to produce more or less foam by adding more or less water for the same amount of fluid. The maximum refill lines for soap and water 68 and 70, respectively, can be used to indicate recommended ratios. Other ways of obtaining a proper a mixture of fluid and water into the loaded cleaning tool include, but are not limited to: using a sealed bag, adding water to the fluid or fluid to water, using a pre-mixed cartridge, using a pod or tablet and either adding the pod/tablet to water in the handle and mixing or adding the pod/tablet to the handle and then adding water and mixing.

Figure 10:
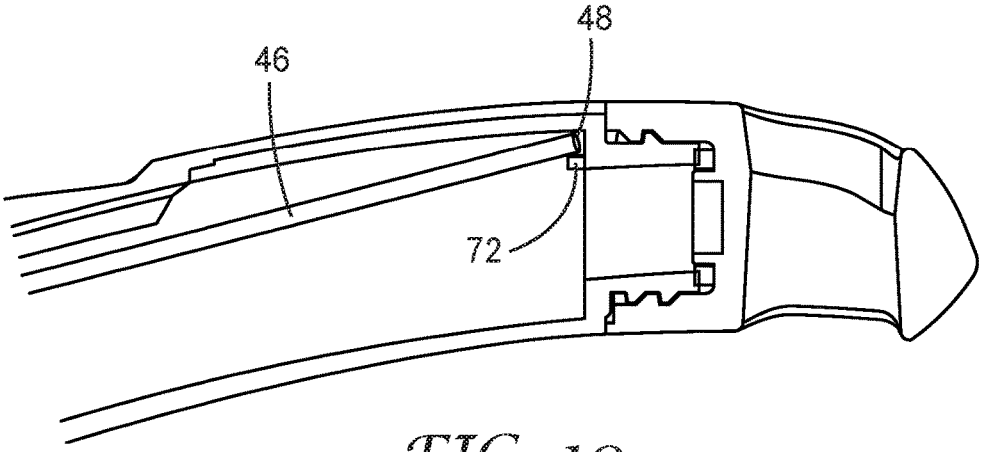
FIG. 10 is a side view of an embodiment of the cleaning tool of the present invention having a feature to position or hold an air tube.

In practice, the loaded cleaning tool 20 of the present invention can be used in many different orientations, i.e. horizontal vs angled vs vertical surfaces. Thus, the air tube 46 must be designed to help reduce the likelihood that fluid 16 will enter the air inlet 48. If fluid 16 enters the air tube 46, there will be minimal to no air, meaning that more fluid, rather than foam, will be dispensed. One means to prevent fluid 16 from entering the air inlet 48 includes incorporating a tube holder, a feature, or tab 72, to keep the air inlet 48 of the air tube 46 in a specific area in the chamber 30, as depicted in the partial side view of FIG. 10. For example, the tab or other feature can hold the air inlet 48 of the air tube 46 in a preferred location within the chamber 30, away from the fluid 16. This positioning will help keep the air inlet 48 of the air tube 46 in the least likely area for fluid to collect, allowing air to flow through the air tube 46 when the foaming mechanism 36 is activated. The tab 72 also functions to maintain access of the air inlet 48 to the air pocket 18 and helps prevent a user from filling the air tube 46 with fluid 16 when refilling the chamber 30.

Figure 11A:
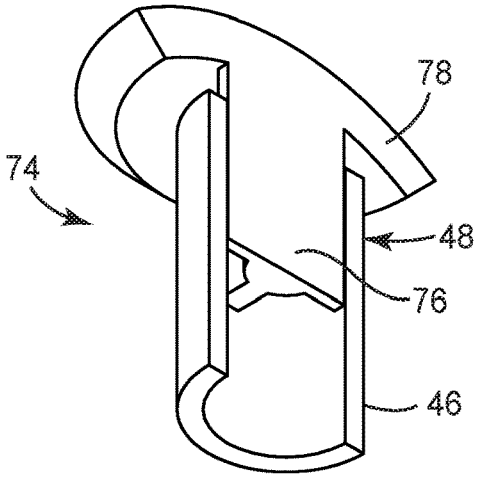
FIGS. 11A and 11B are a cross-sectional perspective view and a top view of a guard used with the cleaning tool of the present invention.
Figure 11B:
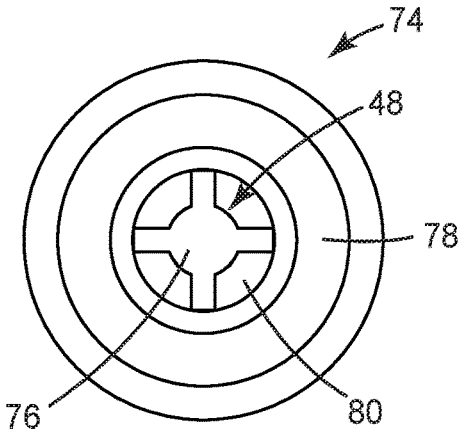

FIGS. 11A and 11B show a perspective view and a front view, respectively, of an embodiment of the foaming mechanism 36 that minimizes the amount of fluid from entering the air tube 46. A guard 74 is positioned at the air inlet 48 of the air tube 46 to prevent excess fluid from entering the air tube 46 while the tool is being used, particularly in aggressive scrubbing applications or on varying angles of cleaning surfaces. The guard 74 includes an insert 76 and a lip 78 extending from an end of the insert 76. The insert 76 has a diameter slightly smaller than an inner diameter of the air tube 46 and is positionable within the air tube 46 at the air inlet 48. The lip 78 rests on the diameter of the air tube 46, providing a partial cover of the air tube 46 and the air inlet 48. Small gaps 80 between the insert 76 of the guard 74 and the air inlet 48 reduces the amount of fluid that may enter while the cleaning tool 20 is being used in various orientations while still allowing air to enter the air inlet 48.

Figure 12A:
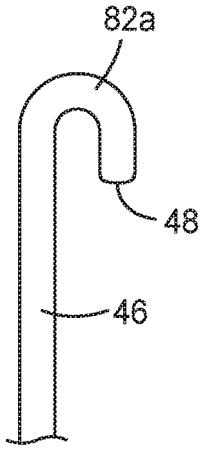
FIGS. 12A and 12B are side views of an embodiment of a looped air tube inlet used with the cleaning tool of the present invention.
Figure 12B:
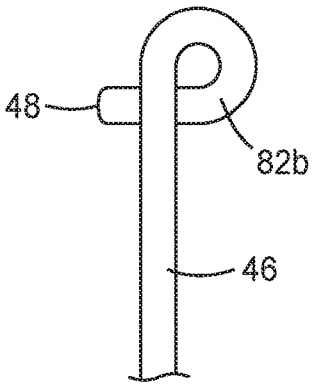

In another embodiment, the air tube 46 can include a loop 82 proximate the air inlet 48. FIGS. 12A and 12B show side views of an air tube 46 with a 180 degree loop 82*a* and a 360 degree loop 82*b*, respectively. In other embodiments, the loop 82 can include other degree loops. The loops 82 help prevent excess fluid from entering the air tube 46 while the tool is being used in various orientations. While FIGS. 12A and 12B show the air tube 46 as including a loop 82 at the air inlet 48, other geometries can be incorporated into the air tube 82 without departing from the intended scope of the present invention.

Figure 13:
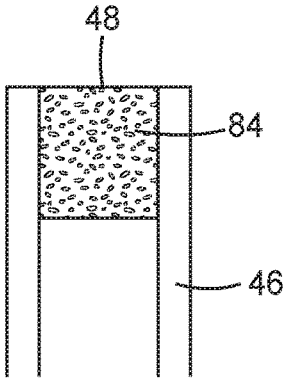
FIG. 13 is a cross-sectional view of an embodiment of the air tube of the cleaning tool of the present invention having a porous membrane.

Another method of preventing excess fluid from entering the air tube 46 is use of a porous membrane 84. FIG. 13 shows a cross-sectional view of the air inlet 48 of the air tube 46 including a porous membrane 84 to prevent fluid from entering while still allowing air into the air tube 46. In one embodiment, the porous membrane 84 is formed from foam.

For optimal performance of the foaming mechanism 36, it is also important to keep the air inlet 48 clear or offset from the end cap 34 or other opening in the handle 22 used to pour the fluid into the fluid reservoir 42 so that when the user refills the fluid reservoir 42 with fluid, the fluid does not go directly into the air tube 46. All of the disclosed methods with respect to FIGS. 10-13 also assist in reducing the likelihood of pouring fluid directly into the air tube 46 when refilling the fluid reservoir 42 in the handle 22 with fluid.

Figure 14A:
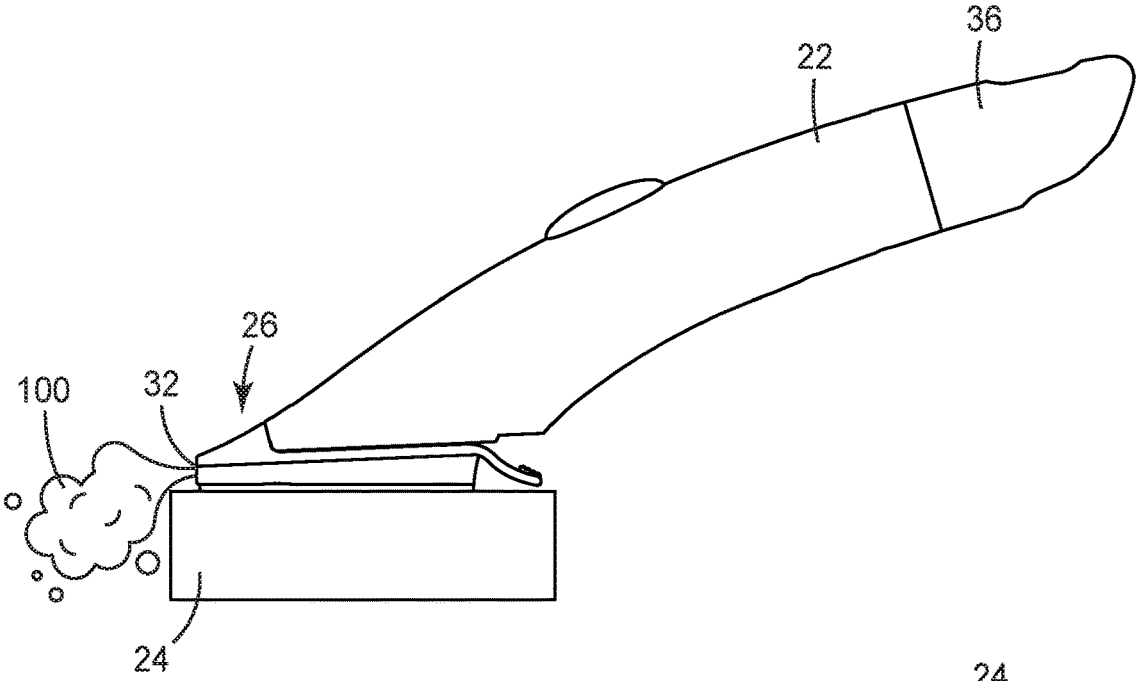
FIGS. 14A and 14B are side views of an embodiment of the cleaning tool of the present invention having alternate foam dispensing locations.
Figure 14B:
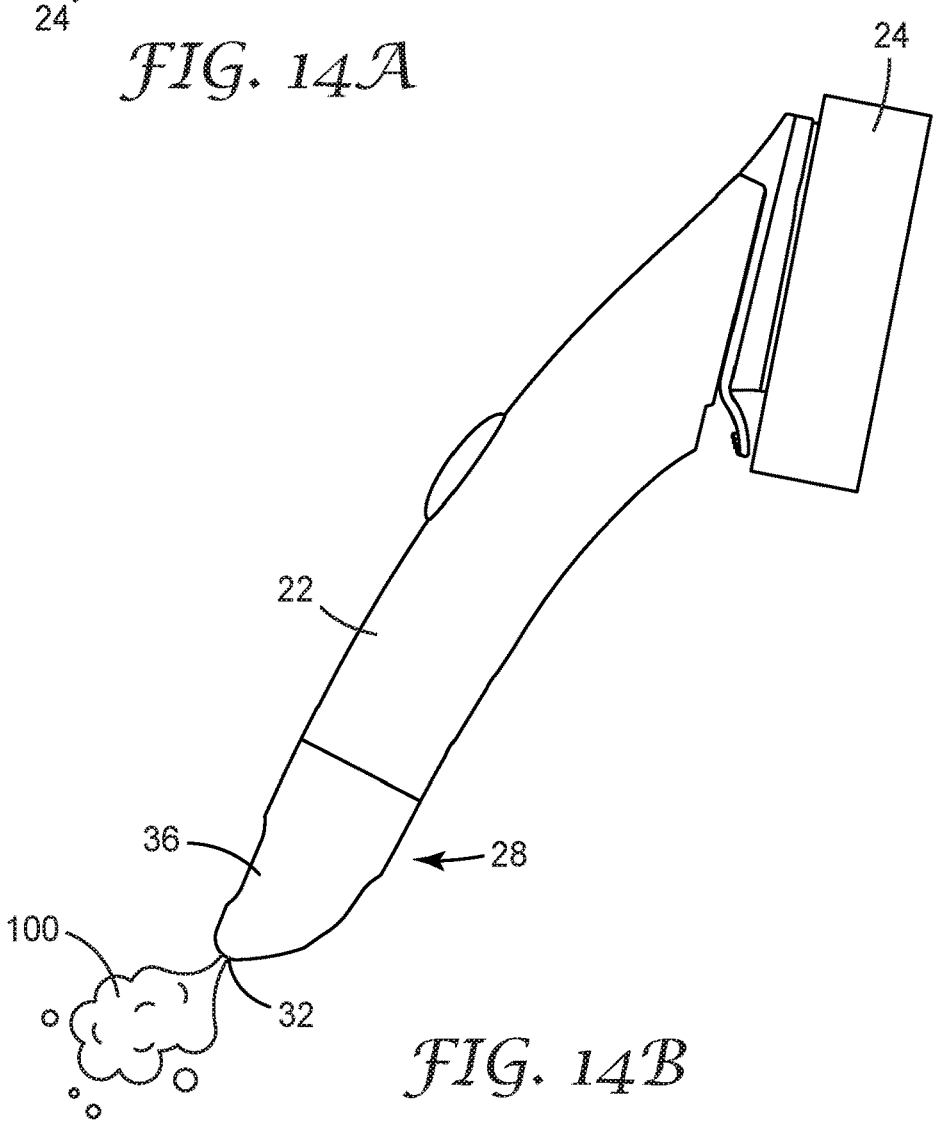

A challenge of incorporating a foaming mechanism into a loaded handle, as compared to, for example, a squeeze bottle, is that the cleaning head is positioned generally proximate the foaming pump and discharge aperture, potentially blocking the path for the air to return back through the foaming pump air return and into the chamber 30. One solution to this challenge is to dispense the foam 100 directly from the handle onto the surface to be cleaned, rather than through the cleaning head, so that the foam 100 does not need to pass through the cleaning head. As previously mentioned, this could be executed by dispensing foam adjacent to the cleaning head at the working end of the cleaning tool (shown in FIG. 14A) or on the end opposite the working end of the cleaning tool, for example, through the end cap (shown in FIG. 14B).

Figure 15A:
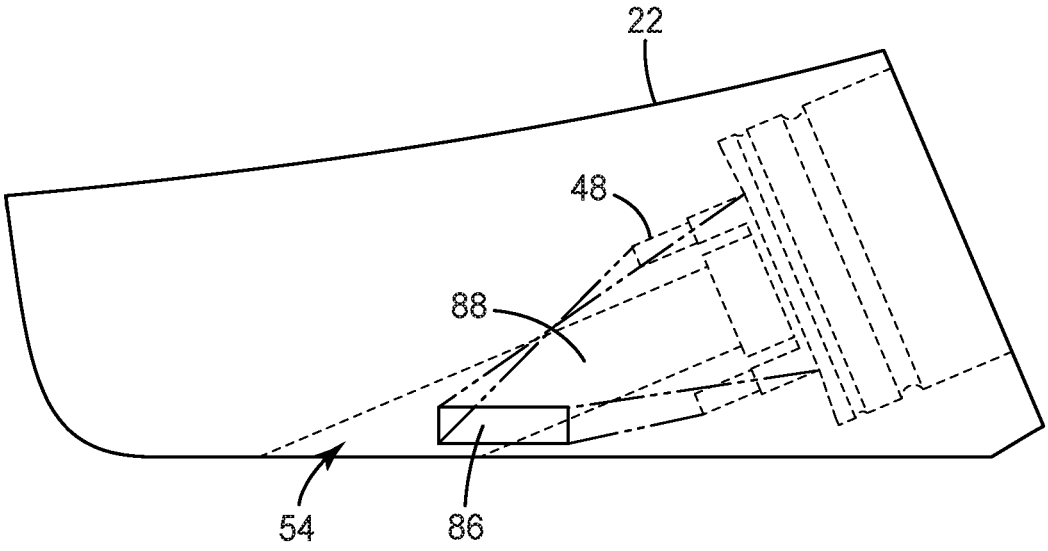
FIGS. 15A and 15B are partial side and perspective views, respectively, of an embodiment of the cleaning tool of the present invention having secondary air inlets.
Figure 15B:
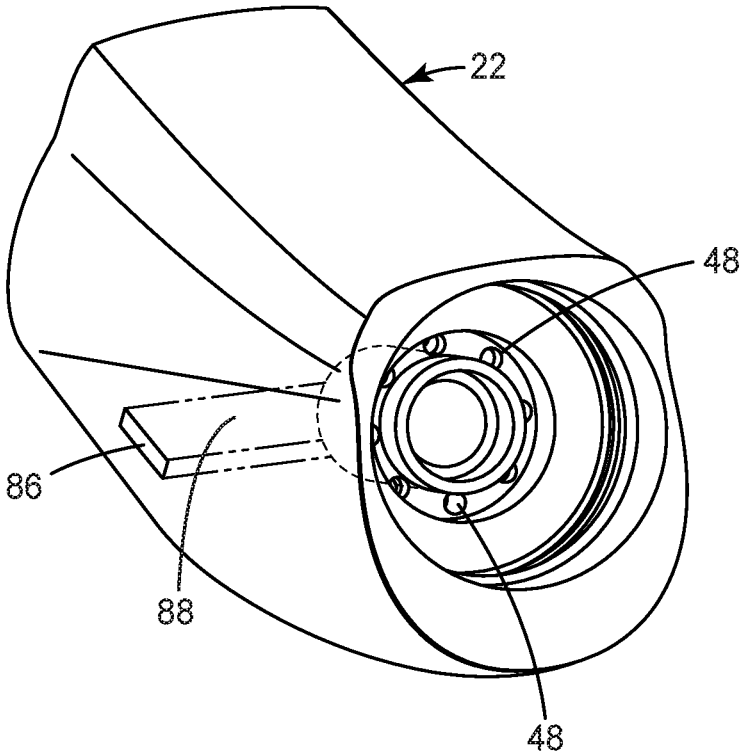

When dispensing foam through the cleaning head, other means may be incorporated into the handle to allow air to return back into the chamber. In an embodiment shown in FIGS. 15A and 15B, which show partial side and perspective views, respectively, a secondary air inlet 86 is positioned on the sides/top/bottom of the handle 22 with a direct air path from the atmosphere to the foaming pump 52 air returns 50 and thus, the chamber 30. A channel 88 extending from the secondary air inlet 86 allows air to travel from the atmosphere to the foaming pump 52 and air return 50 and back into the air pocket 18 of the chamber 30.

Figure 16:
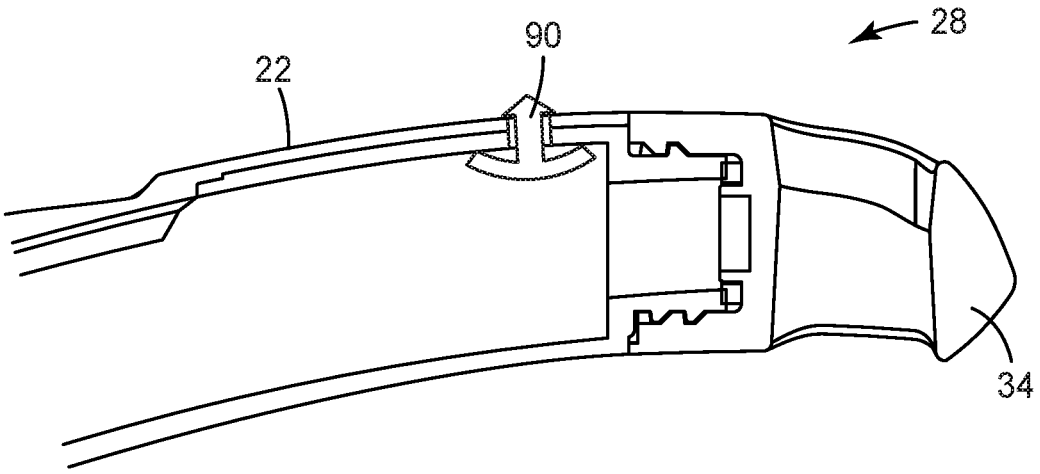
FIG. 16 is a partial side view of an embodiment of the cleaning tool of the present invention having a one-way valve.

In another embodiment designed to maximize air return to the chamber, a one-way/check valve 90 can be located proximate or in the end cap 34 or holding end 28 of the handle 22, as shown in a partial cross-sectional side view in FIG. 16. The one-way valve 90 is positioned within a secondary air inlet and only allows air to enter from the atmosphere when the actuator 38 is released, preventing a vacuum inside the chamber 30 while also preventing both fluid and pressure from exiting the handle 22 when in use or when activating the actuator 38. The one-way air valve 90 can include, but is not limited to, mechanisms such as one-way umbrella or duck bill valves.

Figure 17:
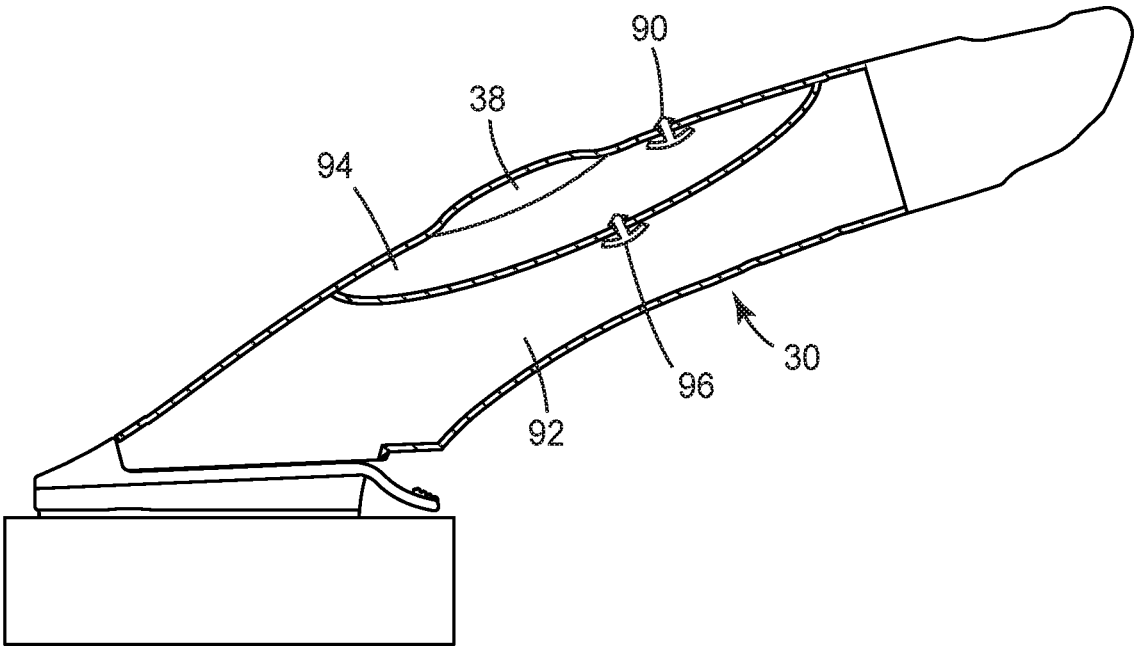
FIG. 17 is a side view of an embodiment of the cleaning tool of the present invention having a two-compartment chamber.

FIG. 17 shows a side view of another embodiment of the cleaning tool 20 and foaming mechanism 36 of the present invention. In this embodiment, the chamber 30 contains two different compartments, a fluid compartment 92 and an air compartment 94. When the actuator 38 is activated, air in the air compartment 94 is displaced into the fluid compartment 92 via a one-way valve 96, thus increasing pressure inside the fluid compartment 92 and moving both fluid and air through the foaming pump 52. Air can then be returned to the air compartment 94 when the actuator 38 is released and rebounds to its resting position via a second one-way air valve 90 as discussed previously in the embodiment discussed relative to FIG. 16.

Even if the air return 50 of the foaming pump 52 is clear of physical obstacles such as the cleaning head 24, another potential challenge is that the dispensed foam can block the air return 50, or water can block air from returning to the chamber. Referring back to FIG. 3A, a means of creating a channel 98 to extend the dispensing aperture 32 further away from the foaming pump 52 and the air return 50 can optionally be used to aid proper function of the air return 50 by ensuring that the air return 50 is not blocked by foam from the discharge aperture 32. In one embodiment, the channel 98 is a rigid or flexible pathway. The discharge aperture 32 is then located at the end of the channel, rather than adjacent the foaming pump 52. For example, a flexible or rigid tube can be adjacent the foam outlet 54 of the foaming pump 52 resulting in the discharge aperture 32, and thus discharging foam, being further away from the foaming pump 52 and air return 50. The handle 22 can also include the channel 98 which would be located adjacent to the foaming pump foam outlet 54 when assembled to extend the discharge aperture 32 from the foam pump air return 50.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of skill in the art without departing from the spirit and scope of the invention. Thus, the scope of the present invention should not be limited to the structures described in this application, but only by the structures described by the language of the claims and the equivalents of those structures.

What is claimed is:

1. A cleaning tool for dispensing foam, the cleaning tool comprising:
- a handle having a working end and a holding end;
- a cleaning head attached to the working end of the handle;
- a foaming mechanism comprising:
  - a chamber;
  - an air pocket;
  - an air tube having an air inlet;
  - a fluid inlet;
  - a fluid reservoir; and
  - a foaming pump; and
- an actuator to displace volume within the chamber.

2. The cleaning tool of claim 1, wherein the cleaning tool is one of a dishwand and a palm brush.

3. The cleaning tool of claim 1, wherein the foaming mechanism further comprises an air return.

4. The cleaning tool of claim 1, wherein the foaming mechanism further comprises a compressed air cartridge.

5. The cleaning tool of claim 1, wherein the foaming mechanism further comprises a pressurizing pump.

6. The cleaning tool of claim 1, wherein the foaming mechanism further comprises a support structure positioned adjacent the actuator to increase spring-back of the actuator.

7. The cleaning tool of claim 1, wherein the foaming mechanism further comprises a means for positioning the air inlet of the air tube.

8. The cleaning tool of claim 1, wherein the foaming mechanism further comprises a guard positioned within the air inlet of the air tube.

9. The cleaning tool of claim 1, wherein an end of the air tube comprises a loop.

10. The cleaning tool of claim 1, wherein the foaming mechanism further comprises a porous membrane positioned within the air inlet.

11. The cleaning tool of claim 1, wherein foam is dispensed from the working end of the handle.

12. The cleaning tool of claim 1, wherein foam is dispensed from the holding end of the handle.

13. The cleaning tool of claim 1, wherein the foaming mechanism further comprises secondary air inlets.

14. The cleaning tool of claim 1, wherein the foaming mechanism further comprises a one-way valve.

15. The cleaning tool of claim 1, wherein the chamber comprises a first compartment and a second compartment.

16. The cleaning tool of claim 1, wherein the foaming mechanism further comprises a means for preventing fluid from entering the air inlet.

17. A cleaning tool for dispensing foam, the cleaning tool comprising:
- a handle having a working end and a holding end;
- a cleaning head attached to the working end of the handle;
- a foaming mechanism comprising:
  - a chamber;
  - an air pocket;
  - an air tube having an air inlet;
  - a fluid inlet;
  - a fluid reservoir; and
  - a foaming pump positioned in the fluid reservoir; and
- an actuator for building pressure within the chamber.

18. The cleaning tool of claim 17, wherein the foaming mechanism further comprises an air return.

19. The cleaning tool of claim 17, further comprising a secondary means for building pressure within the chamber.

20. The cleaning tool of claim 17, a support structure positioned adjacent the actuator to increase spring-back of the actuator.

* * * * *